United States Patent [19]

Thurner et al.

[11] Patent Number: 5,001,983

[45] Date of Patent: Mar. 26, 1991

[54] SUBMUNITION

[75] Inventors: Gunther Thurner, Schwaig; Helmut Hammer, Heroldsberg, both of Fed. Rep. of Germany

[73] Assignee: Diehl GmbH & Co., Nuremberg, Fed. Rep. of Germany

[21] Appl. No.: 497,412

[22] Filed: Mar. 22, 1990

[30] Foreign Application Priority Data

Apr. 21, 1989 [DE] Fed. Rep. of Germany ..... 3913171

[51] Int. Cl.[5] ..... F42B 13/38; F42B 25/02

[52] U.S. Cl. ..... 102/387; 102/354; 102/393

[58] Field of Search ..... 102/387, 393, 337, 339, 102/348, 354

[56] References Cited

U.S. PATENT DOCUMENTS

| | | | |
|---|---|---|---|
| 2,723,876 | 11/1955 | Langlois et al. | 102/387 |
| 3,066,632 | 12/1962 | Bemis | 102/387 |
| 3,153,395 | 10/1964 | Karp | 102/387 |
| 3,351,017 | 11/1967 | Myers | 102/337 |
| 3,382,803 | 5/1968 | Swallow et al. | 102/387 |
| 3,713,387 | 1/1973 | Karp | 102/387 |
| 4,805,532 | 2/1989 | Synofzik et al. | 102/393 |
| 4,889,053 | 12/1989 | Grosswendt et al. | 102/387 |

*Primary Examiner*—David H. Brown

*Attorney, Agent, or Firm*—Scully, Scott, Murphy & Presser

[57] ABSTRACT

An article of submunition which is harnessed as a rotating load through the intermediary of a connecting device to the shroud lines of a parachute. The connecting device is designed as a torque or rotational moment-transmitting spreader arrangement for the radial spacing of the coupling of the shroud lines to a spin line carrying the load; whereby a coupling device is positioned between the connecting device and the spin line, in which the coupling device is constructed as a load-dependent slip coupling for the reduction of the torque which is transmitted from the spin line to the connecting device.

3 Claims, 1 Drawing Sheet

SUBMUNITION

BACKGROUND OF THE INVENTION

1. Field of the Invention

The present invention relates to an article of submunition which is harnessed as a rotating load through the intermediary of a connecting device to the shroud lines of a parachute.

2. Discussion of the Prior Art

A system of that type has become known from the disclosure of German Laid-Open Patent Appln. 23 53 566, and is employed or the deployment of submunition equipped with search heads and which rotatingly descend into a target area. This submunition is set into a rotational movement through the onflow of air produced by guide surfaces relative to the practically punctiform of the parachute shroud lines. In order to prevent the shroud lines from turning or twisting in (and thereby to cause the parachute to pull together such that it looses its braking effect and thereby brings the submunition into a steep dive), a swivel plate is arranged intermediate the shroud lines and the load. However, in actual practice, a rotational movement which is free of torque is unattainable because of the presence of unavoidable influences of friction; inasmuch as the system dimensions allow for the utilization of only a limited swivel plate diameter size, and especially after lengthier storage periods, the coefficients of friction of such a coupling become less satisfactory. Consequently, it is unavoidable that a torque will be transmitted from the rotating load to the conveyance for the shroud lines, so that these will be twisted in relative to the rotation-supportive canopy of the parachute.

In order to be able to eliminate a swivel plate construction, for parachute-load connection of the type considered herein, it is already known to provide intermediate the practically punctiform convergence or juncture of the parachute shroud lines and the actual load a lengthy connecting belt as a spin-decoupling line. A spin line of that kind is twisted prior to the deployment of the system opposite the subsequent direction of rotation for the load whereby, after the release of the rotational movement of the load relative to the braking parachute, initially this belt spin can be attenuated without transmitting of torque into the connection for the shroud lines. It depends upon the length of this belt as to how much spin encountered in the direction of rotation of the load it can thereafter still assume prior to this leading to a noticeable torque loading in the connection for the shroud lines. A lengthy spin line is; however, undersirable due to technological and kinematic reasons associated with the system, inasmuch as it would increase the period of time and the extending and unfolding of the braking parachute subsequent to the release thereof from its packing, so that the load which has been ejected from the spin stabilized deploying carrier at a high altitude would carry out an undesirably lengthy falling motion. The result would be the encountering of a correspondingly higher shock load when the braking parachute finally opens itself. On the other hand, an excessively short spin line does not permit for the implementation of a sufficiently large number of turns up to the build up of that kind of torsional moment or torque, which can lead to the twisting or turning in of the shroud lines and, resultingly, to the steep dropping or dive of the system. Hereby, consideration must also be given to the aspect that with a reducing parachute strength; in effect, at a reducing sinking speed, that the counter-torque which is obtained through the articulation with the shroud lines (hereinafter referred to as shroud lines-torque), will reduce itself, as a consequence of which there is an increase in the danger of the twisting or turning in of the shroud lines due to the torsional moment or torque which is exerted by the spin line. When, there is then additionally separated the load; for instance, in the sense that a parachute cassette together with the braking parachute is blown off from the submunition, and thereby a rotational parachute has been freed on the submunition, this represents a sudden-like additional reduction in the strength of the braking parachute. The turning in of the parachute shroud lines then has, as a consequence, a greater sinking speed of the blown off load constituent, so that this can drop backwards into the rotational parachute for the submunition, and can thereby set the system out of function.

SUMMARY OF THE INVENTION

In recognition of these conditions, it is accordingly an object of the present invention to develop a coupling between a parachute and submunition of the type considered herein in such a manner, as to eliminate the danger of the twisting or turning in of the braking parachute shroud lines.

The foregoing is inventively attained in that the connecting device is designed as a torque or rotational moment-transmitting spreader arrangement for the radial spacing of the coupling of the shroud lines to a spin line carrying the load; whereby a coupling device is positioned between the connecting device and the spin line, in which the coupling device is constructed as a load-dependent slip coupling for the reduction of the torque which is transmitted from the spin line to the connecting device.

In accordance with the foregoing, there is eliminated the heretofore usual, practically punctilinear convergence or juncture of the parachute shroud lines and instead thereof, the harnessing radius of the lower ends of the shroud lines is increased by a suitable radially projecting connecting device. As a result thereof, there is encountered a greater assumed torque with respect to the shroud lines. This torque should always be counteracted when the torque which is introduced from the load rises too intensely in consideration of the momentarily still present strength of the parachute. For this purpose, the connecting device is equipped with a slip coupling or slipping clutch which will break off any transmission of torque from the spin line to the parachute shroud lines when the spin torque becomes excessively high in comparison with the strength of the parachute; in effect, with respect to the axial load acting on the connecting device. As a result, this will ensure that the shroud lines need no longer assume any rotational moment or torque from the spin line when this would lead to the turning in of the shroud lines due to the reduced strength of the parachute. This is because the transmitting torque between the coupling device for the harnessing of the spin line and the connecting device for the harnessing of the shroud lines is dependent upon the strength of the parachute, so that at a reducing parachute strength, the twist-dependent torque of the spin line need finally no longer be assumed by the shroud lines when these would twist or turn in view of the foregoing.

The coupling device; in effect, ensures the presence of the following sequence of operation:

During the first phase of movement, in essence, immediately subsequent to the expulsion of the submunition from an airborne equipment and after the unfolding of the parachute, the submunition which is suspended from the parachute possesses a comparatively high rate of descent. The unfolded or opened parachute is hereby subjected to a large parachute force. The spin line is relatively slightly twisted during this first phase of movement, in essence, it evidences a small number of turns or twists. In this condition, the spin line twisting torque MDL is less than the transmitting torque, so that the spin line twisting torque MDL is completely transferred to the connecting device. This torque is transmitted to the parachute through the shroud lines, as a result of which there is avoided an undesired turning-in or twisting of the shroud lines.

With a reducing parachute strength or force, which results from a reduction in the rate of descent of the parachute, during a second phase of movement which immediately follows the first phase of movement, the torques consisting of MFL (the shroud line torque) and MU (=the transfer torque) are at least approximately proportionally to the square of the rate of descent.

The transfer torque MU from the coupling device is reduced to such an extent that it is always lower than shroud line torque MFL which is transmitted through the shroud lines at a specified parachute strength; in effect, as the maximum shroud line torque MFL.

Through the increase in the twisting; in effect, the twisting of the spin line, there correspondingly increases the spin line torque MDL. As soon as there is reached the condition in which the spin line torque MDL becomes greater than the transfer torque MU between the coupling device and the connecting device, the coupling device begins to turn relative to the connecting device, whereby in this operating condition there is then only transmitted the transfer torque MU. Inasmuch as, as stated herein, the transfer torque MU from the coupling device is lower than the shroud line torque MFL, the transfer torque MU can be entirely transmitted to the parachute, while simultaneously there is avoided the undesired twisting or turning-in of the shroud lines. The parachute thus contains its full effectiveness, and any danger of collision between the submunition cassette which is suspended from the parachute and the submunition, or in essence the rotational parachute to which the submunition is suspended, is completely eliminated.

BRIEF DESCRIPTION OF THE DRAWINGS

Further aspects, features and advantages of the invention can now be more readily ascertained from the following detailed description of an exemplary embodiment of an article of submunition which is ejectable from airborne equipment, taken in conjunction with the accompanying drawings; in which.

DETAILED DESCRIPTION

Figure 1:
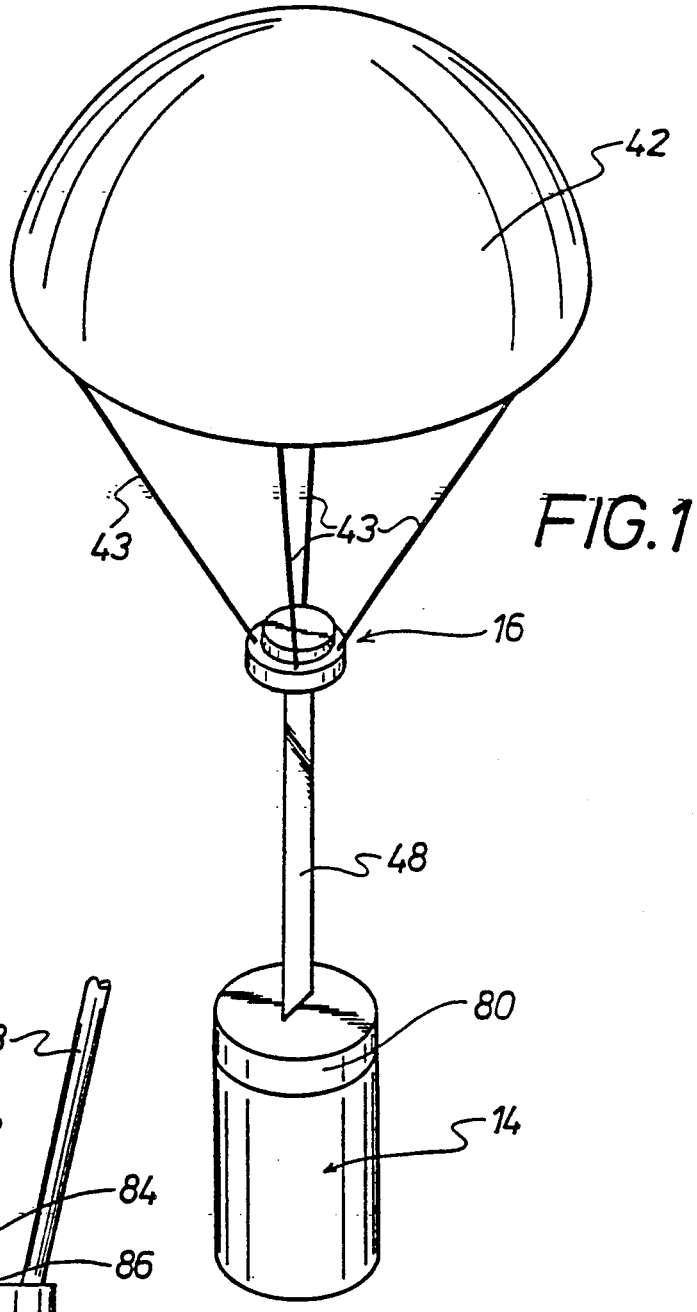
FIG. 1 illustrates a perspective representation of an article of submunition which is suspended from an unfolded or opened parachute.

FIG. 1 illustrates an unfolded or opened parachute 42 having a connecting device 16 harnessed thereto by means of shroud lines 43. A spin line 48 is attached to the connecting device 16, and with a submunition-cassette 80 being fastened to an end portion of the spin line which is remote from the connecting element 16. Detachably connected with the submunition-cassette 80 is an article of submunition 14.

Figure 2:
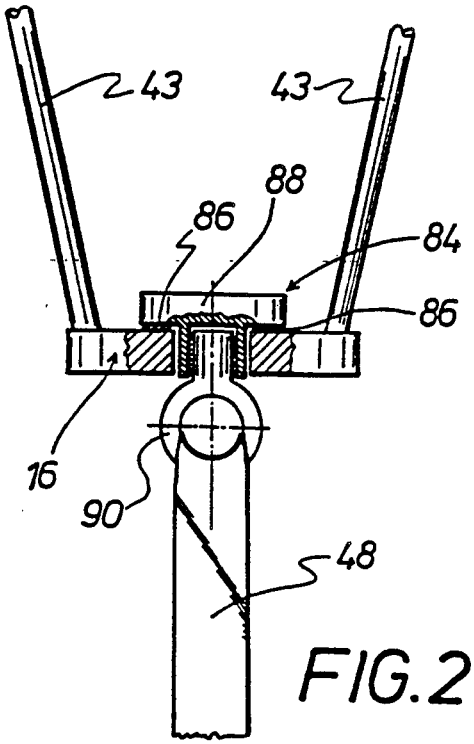
FIG. 2 illustrates, on an enlarged scale, a fragmentary detail of the system pursuant to FIG. 1, which is located intermediate the shroud lines and the partially represented spin line.

FIG. 2 illustrates, in a fragmentary sectional representation, the connecting device 16, to which there are fastened the shroud lines 43 at one end portion of the latter. A coupling device 84 is in frictional engagement with the connecting device 16, whereby a friction contact surface 86 is present intermediate the connecting device 16 and the coupling device 84. The coupling device 84 includes a plate element 88 and a fastening element 90 which is connected with the plate element 88, and having the spin line 48 fastened thereto at its end portion which is distant from the submunition-cassette 80. The fastening element 90, in the exemplary embodiment illustrated in this drawing figure, is configured as a so-called eyebolt.

What is claimed is:

1. Submunition harnessed as a rotating load through connecting means to shroud lines of a parachute, said connecting means comprising a spreading device transmitting torques for the radially projected distancing of the connection of the shroud lines to a spin line carrying said load; coupling means being arranged intermediate the connecting means and the spin line, said coupling means being a load-dependent slipping clutch for effectuating a reduction in the torque which is transferred from the spin line to the connecting means.

2. A submunition as claimed in claim 1, wherein said coupling means is in frictional contact with the connecting means.

3. A submunition as claimed in claim 1, wherein said coupling means includes a plate element contacting said connecting means in frictional engagement and a fastening element for the spin line which is connected with said plate element.

* * * * *